US010207401B1

(12) United States Patent
Pedrin

(10) Patent No.: US 10,207,401 B1
(45) Date of Patent: Feb. 19, 2019

(54) MAGNETIC TOOL BIT WALLET

(71) Applicant: Daniel Pedrin, Belfair, WA (US)

(72) Inventor: Daniel Pedrin, Belfair, WA (US)

( * ) Notice: Subject to any disclaimer, the term of this patent is extended or adjusted under 35 U.S.C. 154(b) by 0 days.

(21) Appl. No.: 15/728,408

(22) Filed: Oct. 9, 2017

Related U.S. Application Data

(63) Continuation-in-part of application No. 29/613,993, filed on Aug. 15, 2017.

(51) Int. Cl.
*B25H 3/00* (2006.01)

(52) U.S. Cl.
CPC ..... *B25H 3/003* (2013.01)

(58) Field of Classification Search
CPC . A45C 11/24; A45C 13/02; A45C 3/00; A45F 5/00; B25H 3/003; B25H 3/00; H01F 7/0215
USPC ..... 206/350, 818; 224/562, 183; 211/DIG. 1; 248/309.4
See application file for complete search history.

(56) References Cited

U.S. PATENT DOCUMENTS

| | | | | |
|---|---|---|---|---|
| 4,508,221 | A | 4/1985 | Olson | |
| 4,736,853 | A * | 4/1988 | O'Mara | A45C 11/00 206/224 |
| 4,826,059 | A | 5/1989 | Bosch et al. | |
| 5,056,661 | A | 10/1991 | Balzano | |
| 5,460,305 | A | 10/1995 | Ahearn | |
| 5,593,073 | A * | 1/1997 | Finnegan | A44C 5/0007 224/183 |
| 5,598,923 | A * | 2/1997 | Owens | A61B 50/312 150/130 |
| 6,276,277 | B1 * | 8/2001 | Schmacker | F42B 10/00 102/374 |
| 6,336,555 | B1 * | 1/2002 | Breeden | A45C 11/24 206/214 |
| 6,587,022 | B1 | 7/2003 | Devine | |
| 6,910,578 | B2 | 6/2005 | Stern | |
| 6,945,503 | B2 | 9/2005 | Cohen | |
| 7,971,277 | B2 | 7/2011 | Romiti | |
| 9,472,127 | B2 * | 10/2016 | Tatum | G09F 7/08 |
| 9,693,614 | B1 * | 7/2017 | Brian | A45C 13/1069 |
| 9,936,782 | B2 * | 4/2018 | Puopolo | A45C 13/001 |
| 2005/0139558 | A1 * | 6/2005 | Kephart | A47G 29/08 211/13.1 |

OTHER PUBLICATIONS

Pedrin, D., "Tool Bit Wallet," U.S. Appl. No. 29/613,993, filed Aug. 15, 2017.

* cited by examiner

*Primary Examiner* — Chun Cheung
(74) *Attorney, Agent, or Firm* — Christensen O'Connor Johnson Kindness, PLLC; Ryan E. Dodge, Jr.

(57) ABSTRACT

A magnet tool bit wallet includes a fabric body formed from first and second overlying panels, and having a magnetic support portion, a bit retainer portion, and a closeable pocket portion. The magnetic support portion encloses a pair of elongate magnet assemblies between the panels, each magnet assembly including a row of disc magnets disposed between a pair of ferromagnetic strips. The rows of disc magnets have opposite polarity to adjacent magnets, and opposite polarity to corresponding magnets in the other magnet assembly. The bit retainer portion includes at least one block configured to retain tool bits. In a folded configuration the magnet assemblies overlie each other, and a flap on the magnetic portion overlies the pocket portion to retain the wallet in the folded configuration.

18 Claims, 4 Drawing Sheets

MAGNETIC TOOL BIT WALLET

CROSS-REFERENCE TO RELATED APPLICATION

This application is a continuation-in-part of application Ser. No. 29/613,993, filed Aug. 15, 2017, the entire disclosure of said application is hereby incorporated by reference herein.

BACKGROUND

Mechanics, technicians, hobbyists, and others working on mechanical devices and equipment often require tools and tool bits having a number of different sizes, characteristics, and purposes. Typically, for example, a handheld tool is configured to perform a variety of different functions, wherein the user merely chucks or otherwise installs the appropriate tool bit to perform a selected function. Similarly, different bits may be required for engaging different sizes of attachment hardware or the like. Switching between different tool bits can present a number of challenges to the user. For example, the user must bring the desired tool bits to the work site, identify and select the desired tool bit for each particular step requiring a tool bit, keep track of tool bits after they are used and replaced with a subsequent bit, such that the tool bit remains readily available, and keep the tool bits available so they may be conveniently retained for future tasks. If a first tool bit is merely set aside when a second tool bit is required, the first tool bit may be subject to loss, or to being bumped or kicked, adding annoyance and frustration to accomplishing the job at hand. In addition, small hardware items, such as bolts, screws, washers, and nuts that are removed are subject to being misplaced during the course of working on a project, potentially resulting in the loss of components critical to completion of the task. These types of problems and frustrations are, of course, as well known to weekend home do-it-yourselfers as they are to professional tradespersons.

Various tool caddies and the like have been proposed to address this problem. For example, U.S. Pat. No. 4,508,221, to Olsen, discloses a tool caddy for holding a variety of small tools such as drill bits, saw blades, or the like for a power tool. The tool caddy is configured to be adhesively attached directly to a power tool. Olsen discloses a cover sheet with tool-receiving pockets and an elastic strap or band to retain tool bits, chuck key, or the like. Similarly, U.S. Pat. No. 5,506,661, to Balzano, discloses a tool caddy that attaches directly to the hand tool, and uses a hook and pile fastener, and may optionally include a belt loop attachment.

U.S. Pat. No. 6,910,578, to Stern, discloses a portable hand power tool accessory holder, base strip for attachment to the hand tool, and an elastic band carried by the base strip forming a plurality of sleeves for retaining tool bits. A restraining magnet is included for engaging the bits, and a utility magnet is carried in the elastic band to magnetically engaging the bits for temporary storage.

U.S. Pat. No. 5,460,305, to Ahern, discloses a large panel that includes a number of tool pouches. The perimeter of the large panel is provided with a beveled edge comprising a series of magnetics or a magnetic strip for attaching the panel to the side of an automobile. The large panel includes a plurality of pouches into which tools may be inserted during use. Ahern does not disclose or contemplate or provide any mechanism for retaining tool bits or hardware parts, or any closeable means for storage of parts and bits. U.S. Pat. No. 4,826,059, to Bosch et al., discloses a portable magnetic tool holder with a rear face that includes a plurality of magnetic bars positioned vertically and side by side across an upper portion of the flexible main body of the tool holder. The tool holder includes pockets, loops, and straps for retaining tools. U.S. Pat. No. 6,587,022, to Devine, discloses a foldable portable magnetic tool mat. Elongate bar magnets are disposed in holding portions defined in the tool mat. A strap system is provided to attach the mat, for example, to a ladder surface. Tools may be releasably retained by merely placing them on the tool mat.

There remains a need for a tool wallet that is configured to retain tool bits and optionally small magnetically susceptible hardware items, that provides both easy retention and release during use, provides longer-term storage options, and that is suitable for use to temporarily retain bits and hardware with the wallet in a vertical orientation.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

A magnetic tool bit wallet having a pliable body, for example, a fabric body, is configured to be movable between a deployed configuration and a folded configuration. A first panel is fixed about a perimeter to a second panel to form the pliable body. The body includes a magnetic support portion with an end flap, a bit retainer portion extending from the magnetic support portion, and a pocket portion extending from the bit retainer portion. The bit retainer portion includes one or more blocks or other elements for releasably retaining a plurality of tool bits. A first elongate magnet assembly and a second elongate magnet assembly are disposed between the first and second panels in the magnetic support portion of the pliable body. The first and second elongate magnet assemblies include a first ferromagnetic strip, a second ferromagnetic strip, and a row of magnets disposed between the first and second strips. The magnets in each row are arranged with alternating magnetic polarities, and each magnet in the first row of magnets is oriented with an opposite polarity to a neighboring magnet in the second row of magnets.

In an embodiment, in the folded configuration the pocket portion overlies the bit retainer portion, and the first magnet assembly magnetically engages the second magnet assembly such that the magnetic support portion is retained in a folded configuration by the end flap overlying and engaging the pocket portion.

In an embodiment an element for releasably retaining the plurality of tool bits is a block having a plurality of openings, for example, cylindrical channels or apertures that extend at least partially through the blocks. In other embodiments the retaining mechanism is a mechanical clip or the like. In some embodiments the retaining elements, for example blocks, are adhesively attached to a protective panel that is sewn onto the pliable body.

In an embodiment the rows of magnets comprise rows of disc magnets.

In an embodiment the pocket portion of the pliable body includes an openable closure mechanism, for example, a zipper or hook-and-loop-type fastener.

In an embodiment a small pocket is formed in the magnetic support portion of the pliable body and the first and second magnet assemblies are sized to approximately fill the small pocket such that the small pocket prevents the magnets in the rows of magnets from sliding away from the corresponding first and second ferromagnetic strips.

A magnetic tool bit wallet is movable between a deployed configuration and a storage configuration. The magnetic tool bit wallet includes a fabric body comprising an elongate fabric sheet folded about a fold line to define a first fabric panel portion fixed about a perimeter to a second fabric panel portion, the fabric body comprising a magnetic support section with an end flap, a bit retainer section extending from the magnetic support section comprising means for releasably retaining a plurality of tool bits, and a closeable pocket section extending from the bit retainer section. A first elongate magnet assembly and a second elongate magnet assembly disposed between the first and second fabric panel portions, each of the first and second elongate magnet assemblies comprising a first ferromagnetic strip, a second ferromagnetic strip, and a row of magnets disposed between the first and second ferromagnetic strips. The magnets in each row of magnets are arranged with alternating magnetic polarities, and further wherein each magnet in the row of magnets in the first magnet assembly is oriented with an opposite polarity to a neighboring magnet in the row of magnets in the second magnet assembly.

In an embodiment the closeable pocket section overlies the bit retainer section, and the first elongate magnet assembly engages the second elongate magnet assembly such that the magnetic support section is retained in a folded configuration such that the end flap overlies and engages the pocket section to thereby retain the pocket section in the storage configuration.

In an embodiment the means for releasably retaining the plurality of tool bits comprises a pair of blocks, each block having a plurality of channels.

In an embodiment the plurality of channels comprise a plurality of cylindrical apertures extending at least partially through the corresponding block.

In an embodiment a protective panel attaches between the fabric body and the pair of blocks.

In an embodiment the rows of magnets comprise rows of disc magnets.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
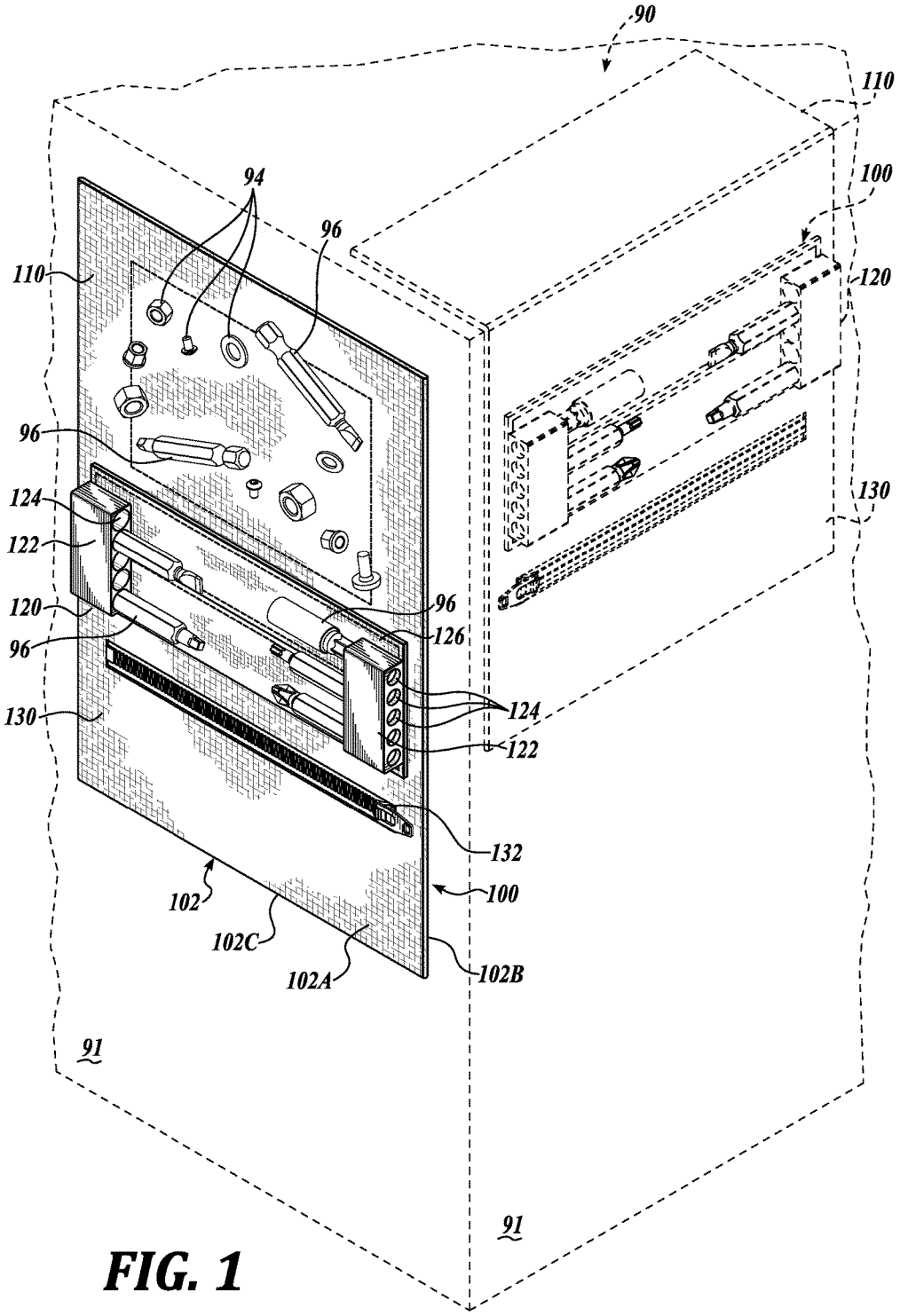
FIG. 1 is an environmental view of a magnetic tool bit wallet in accordance with the present invention, showing the tool bit wallet in use, and retaining tool bits and miscellaneous hardware items, in two different configurations.

An environmental view of a magnetic tool bit wallet 100 in accordance with the present invention is shown in FIG. 1. The magnetic tool bit wallet 100 is shown in a deployed configuration, with the tool bit wallet 100 magnetically secured on a ferromagnetic vertical surface 91, for example, a panel of an apparatus or device 90. An alternative position for the deployed tool bit wallet 100 is shown in phantom, with an upper portion of the tool bit wallet 100 conforming to surfaces forming an edge portion of the apparatus 90, providing enhanced security for holding the tool bit wallet 100 on the apparatus 90.

The tool bit wallet 100 has a pliable body 102, for example, a rugged fabric body. In some embodiments the pliable body is formed from a canvas fabric, for example, a canvas made from cotton, linen, and/or hemp. In another embodiment the fabric is a denim fabric. In another embodiment the fabric is a synthetic fabric. The pliable body 102 in this embodiment is formed from a first panel 102A (facing outwardly in FIG. 1), and a second panel 102B (disposed against the surface 91 in FIG. 1). The panels 102A, 102B are joined along their perimeter, forming a usable volume therebetween at least along a portion of the body 102. For example, in a current embodiment the first panel 102A and second panel 102B are formed from a single elongate rectangular sheet folded along a fold line 102C forming the lower end of the tool bit wallet 100 in FIG. 1. The panels 102A, 102B are joined along the side and top edges by stitching and/or adhesively. For example, the first panel 102A may include extending edge portions that fold over the second panel 102B, and are fixed to the second panel 102B. In another embodiment an edge tape (not shown) may be sewn or fixed about the edges to join the first panel 102A to the second panel 102B. The usable enclosed volume is described in more detail below.

The tool bit wallet 100 includes three regions or portions, (i) a magnetic support portion 110, (ii) a central bit retainer portion 120, and (iii) an enclosure or closeable pocket portion 130, as discussed in more detail below.

During use the magnetic support portion 110 of the tool bit wallet 100 is configured to releasably secure the tool bit wallet 100 to a ferromagnetic surface 91, typically with the tool bit wallet 100 in the unfolded or deployed configuration shown in FIG. 1. For example, the ferromagnetic surface 91 may be the housing of an appliance or other apparatus 90 that is to be inspected, repaired, or otherwise assembled or disassembled. Alternatively, the ferromagnetic surface 91 may be any convenient ferromagnetic surface, for example, a surface located near the apparatus to be inspected or repaired. As also illustrated in FIG. 1, the magnetic support portion 110 is configured to releasably retain ferromagnetic parts 94, 96 on at least a portion of an outwardly facing surface of the magnetic support portion 110. The ferromagnetic parts 94, 96 may include, for example, attachment hardware 94 associated with the apparatus 90, tool bits 96 such as bits for removing or installing attachment hardware 94, inspection or testing devices (not shown), or the like. Similarly, a ferromagnetic component, such as a small panel (not shown) or a tool bit 96 may be used to attach a non-ferromagnetic item (for example, a printed diagram or instructions) to the magnetic support portion 110, for example, by placing the item between the portion 110 and the tool bit 96.

The bit retainer portion 120 of the tool bit wallet 100 in this embodiment includes one or more bit blocks 122 (two shown) that are configured to releasably retain standard tool bits 96, providing the user easy access to the tool bits 96. In a current embodiment two oppositely-disposed bit blocks 122 are secured near outer edges of the pliable body 102. The bit blocks 122 in a current embodiment are formed of plastic, and have a plurality of circular apertures forming channels 124 (e.g., five channels) that are each sized to receive in friction an end of the tool bits 96. The channels 124 in an exemplary embodiment are cylindrical through holes with a lip (not shown) on an outer end of the channel 124. The lip provides a stop when inserting a tool bit 96. In other embodiments the bit blocks 122 may be constructed of other materials, and/or include differently shaped apertures or different retaining mechanisms. For example, the bit blocks may be formed with a different mechanism for retaining tool bits 96 such as spring wire members, metal clips, small magnets, or the like, as are known in the art. The bit blocks 122 are attached, for example, by a permanent adhesive, rivets or other attachment hardware, or the like. In a current embodiment the bit blocks 122 are adhesively fixed to one or more protective panels 126 that are attached to the body 102 by stitching. The protective panels 126 may be formed from any suitable material, for example, a woven nylon material. In another embodiment two bit blocks 122 are mounted or integrally formed with a flat panel portion joining the blocks 122, and the flat panel portion is disposed between the first and second panels 102A, 102B, such that the bit blocks 122 extend through suitable apertures in the first panel 102A.

The closable enclosure or pocket portion 130 of the tool bit wallet 100 is located on an opposite end portion of the pliable body 102. The pocket storage volume is defined between the first and second panels 102A, 102B in the pliable body 102. In the embodiment shown in FIG. 1 the pocket portion 130 includes a zipper-type closure 132, although other closure mechanisms are contemplated as are known in the art, including snaps, hook and loop fasteners, and the like. The pocket portion 130 provides a container for the tool bits 96 or other items, and provides secure storage, for example, for long term storage when the tool bit wallet 100 is not in use.

Figure 2A:
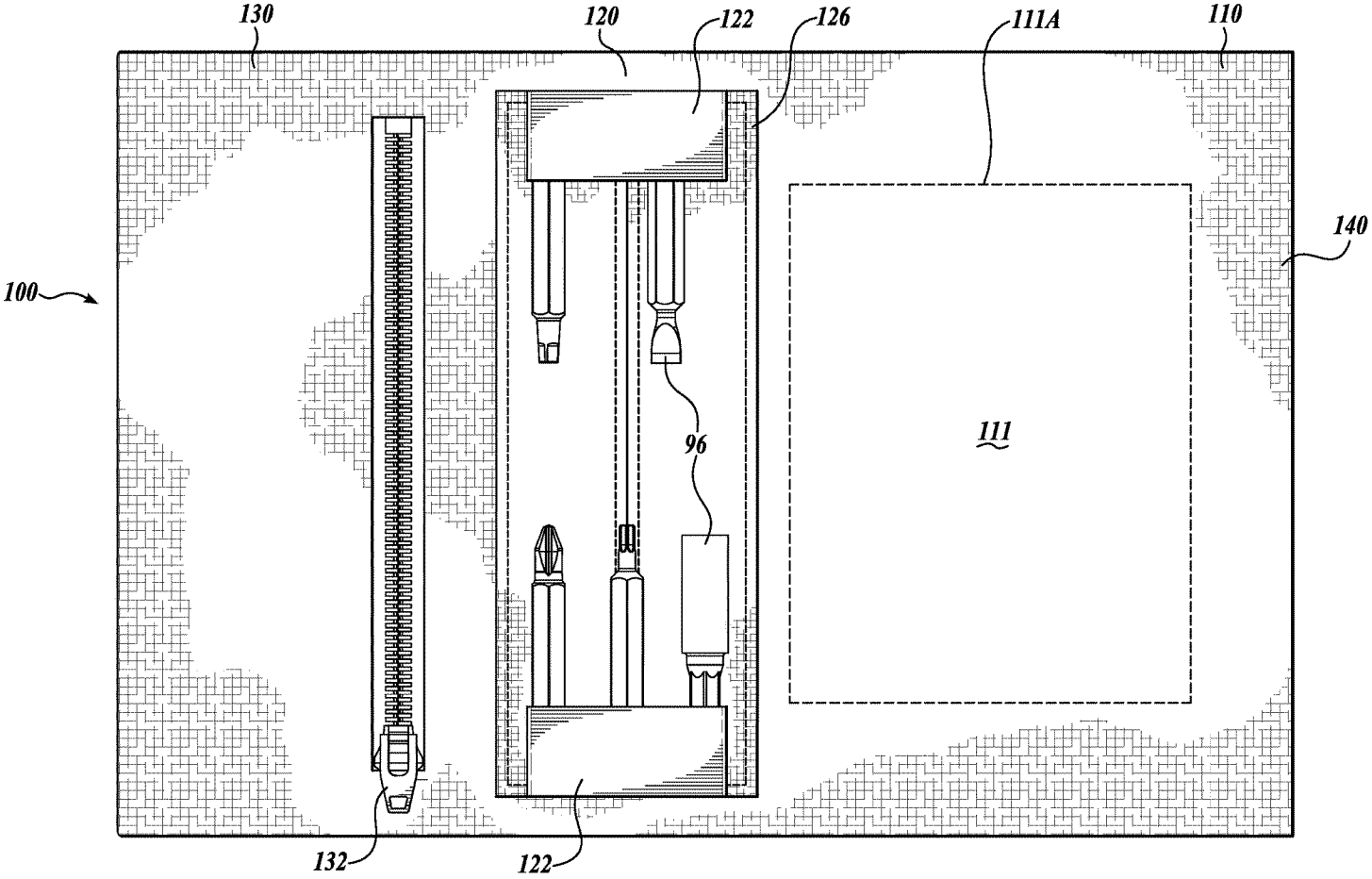
FIG. 2A is a plan view of the tool bit wallet shown in FIG. 1, in a deployed configuration.
Figure 2B:
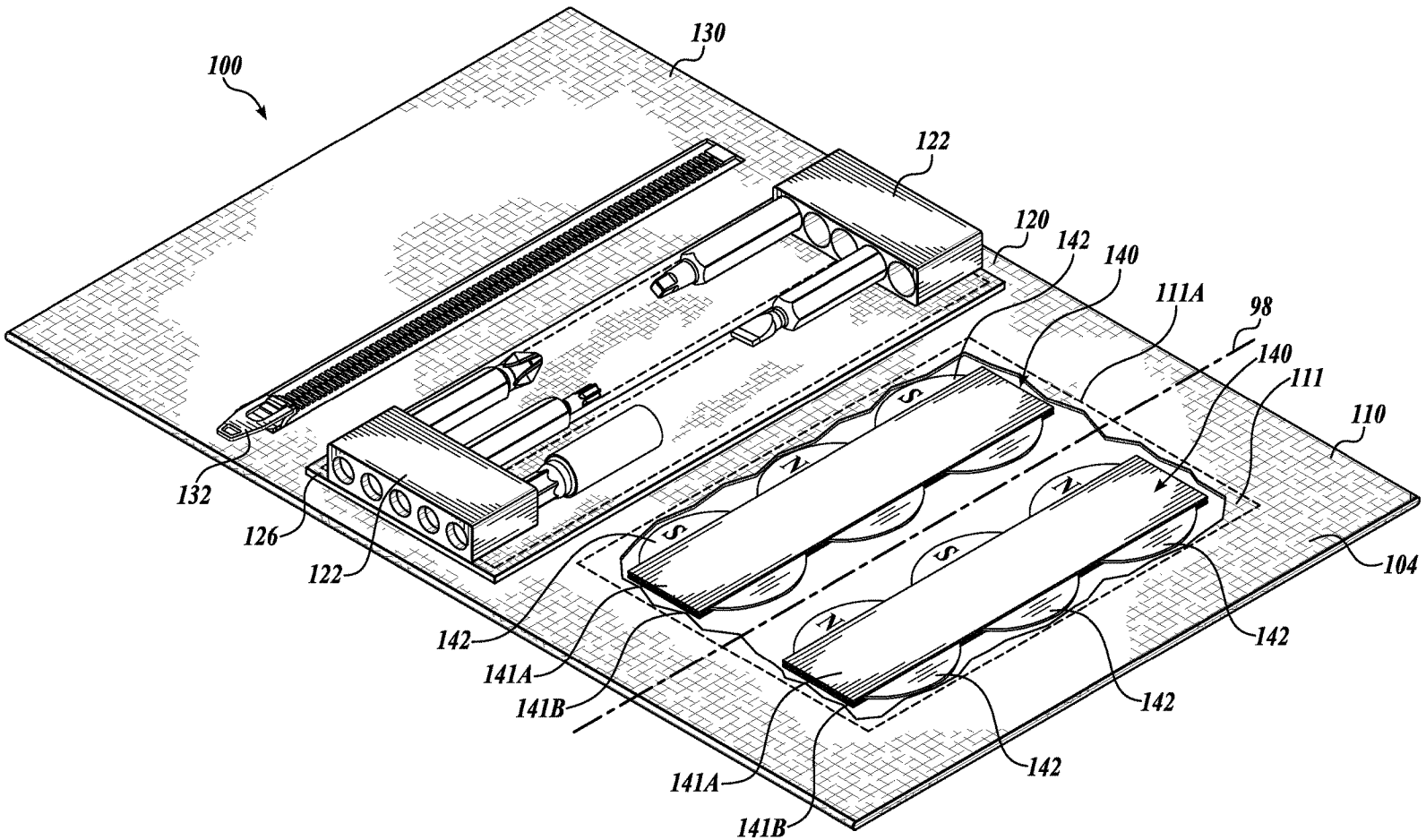
FIG. 2B is a partially broken-away perspective view of the magnetic tool bit wallet shown in FIG. 1 in the deployed configuration.

Refer now to FIG. 2A illustrating a plan view of the tool bit wallet 100 in the deployed configuration, and retaining a plurality of tool bits 96 (five shown) in the bit blocks 122. Refer also to FIG. 2B, showing a perspective view of the tool bit wallet 100 with a portion of the first panel 102A broken away to show an inner volume or pocket 111 enclosing a pair of elongate transverse magnet assemblies 140 disposed in the pocket 111 between the panels 102A, 102B. The magnetic support portion 110 of the pliable body 102 is relatively larger than the bit retainer portion 120, and is also relatively larger than the pocket portion 130. The perimeter of the inner pocket 111 between the upper and lower panels 102A, 102 may be defined, for example, by a stitching 111A.

Each of the magnet assemblies 140 comprises an upper ferromagnetic strip 141A, a lower ferromagnetic strip 141B, and a plurality of thin disc permanent magnets 142 (three shown) disposed between the upper and lower strips 141A, 141B. For example, the disc magnets 142 may be rare earth magnets. As indicated (with "N" and "S") in FIG. 2B, the disc magnets 142 in each magnet assembly 140 are arranged with alternating polarity, i.e., with the north pole (N) of each disc magnet 142 neighboring the south pole (S) of adjacent disc magnets 142. The magnet assemblies 140 extend in parallel transversely across the pocket 111, and are arranged such that the polarity of the corresponding disc magnets 142 between the assemblies 140 are also alternating. In a current embodiment the upper and lower ferromagnetic strips 141A, 141B are fixed to an inner surface of the pliable body 102, for example, with an adhesive, and the pocket 111 size defined by the stitching 111A is configured to snugly retain the magnet assemblies 140 such that the magnet assemblies 140 are constrained to remain assembled as shown, without additional attachment hardware. An end flap 104 is defined at an end of the body 102, extending away from the magnetic assemblies 140.

It will now be appreciated from FIG. 2B that if the pliable body 102 is folded generally about a transverse line 98 indicated in FIG. 2B, the magnet assemblies 140 will be positioned to magnetically engage each other, with magnetic north poles directed to engage magnetic south poles.

Figure 3:
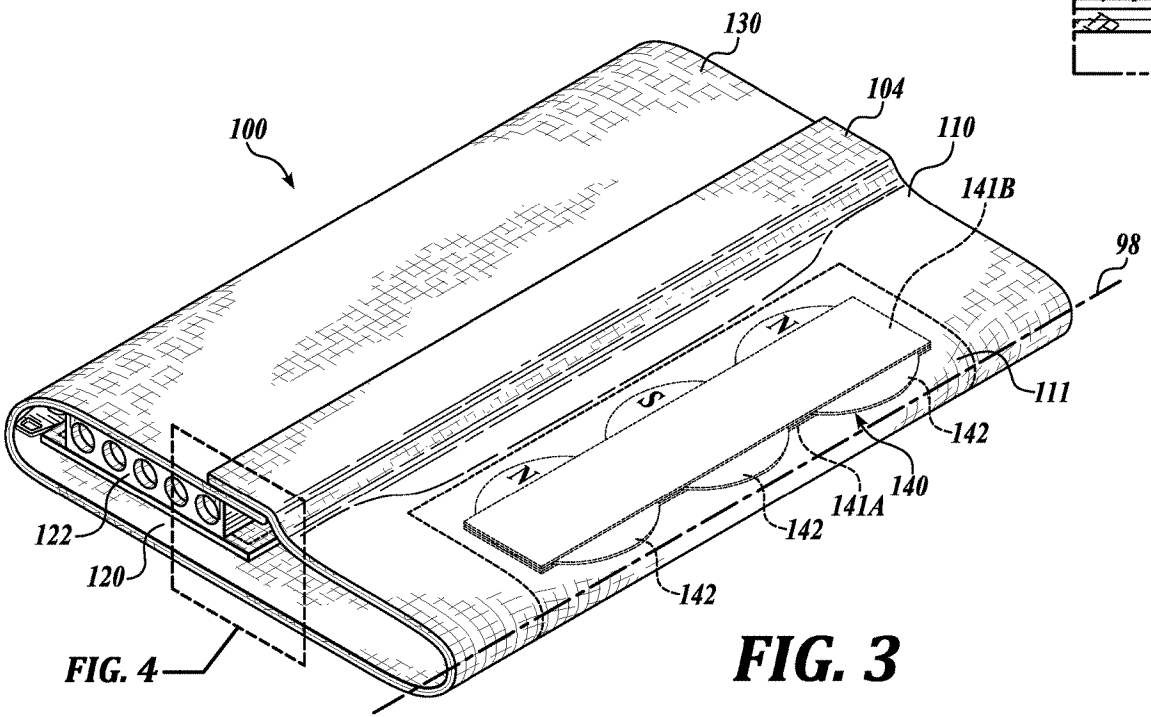
FIG. 3 is a perspective view of the magnetic tool bit wallet shown in FIG. 1 in a folded configuration.

Referring now to FIG. 3 wherein the tool bit wallet 100 is shown in a folded or storage configuration, with one of the magnet assemblies disposed in the pocket 111 shown in phantom. In the folded configuration the two magnet assemblies 140 are located to magnetically engage with the magnetic assemblies 140 disposed closely spaced. It will be appreciated that each of the plural disc magnets 142 in one of the magnet assemblies 140 magnetically engages a corresponding one of the plural disc magnets 142 in the other magnet assembly 140. The magnet assemblies 140 therefore securely and releasably hold the magnetic support portion 110 in a folded configuration.

Figure 4:
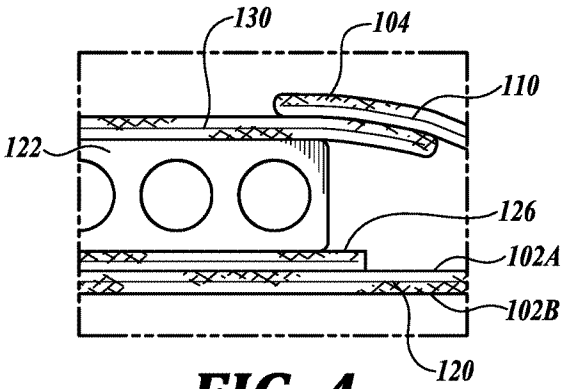
FIG. 4 is a detail end view showing an overlap portion of the magnetic portion for retaining the tool bit wallet in the folded configuration.

FIG. 4 is a detail view illustrating the overlapping region of the tool bit wallet 100 in the folded configuration. It will appreciated that in the folded configuration the end flap 104 overlies an end of the pocket portion 130, and is configured to releasably hold the magnetic tool bit wallet 100 in the folded configuration.

While illustrative embodiments have been illustrated and described, it will be appreciated that various changes can be made therein without departing from the spirit and scope of the invention.

The embodiments of the invention in which an exclusive property or privilege is claimed are defined as follows:

1. A magnetic tool bit wallet movable between a deployed configuration and a folded configuration, the magnetic tool bit wallet comprising:

a pliable body having a first panel fixed about a perimeter to a second panel, the pliable body comprising a magnetic support portion having an end flap, a bit retainer portion extending from the magnetic support portion and comprising means for releasably retaining a plurality of tool bits, and a pocket portion extending from the bit retainer portion enclosing a containment volume between the first and second panels; and a first elongate magnet assembly and a second elongate magnet assembly, wherein the first and second magnet assemblies are disposed between the first and second panels in the magnetic support portion of the pliable body, each of the first and second elongate magnet assemblies comprising a first ferromagnetic strip, a second ferromagnetic strip, and a row of magnets disposed between the first and second ferromagnetic strips; and wherein the magnets in each row of magnets are arranged with alternating magnetic polarities, and further wherein each magnet in the row of magnets in the first magnet assembly is oriented with an opposite polarity to a neighboring magnet in the row of magnets in the second magnet assembly.

2. The magnetic tool bit wallet of claim 1, wherein in the folded configuration the pocket portion overlies the bit retainer portion and the first magnet assembly magnetically engages the second magnet assembly such that the magnetic support portion is retained in a folded configuration such that the end flap overlies and engages the pocket portion.

3. The magnetic tool bit wallet of claim 1, wherein the means for releasably retaining the plurality of tool bits comprises at least one block having a plurality of openings, each opening configured to releasably retain one of the plurality of tool bits.

4. The magnetic tool bit wallet of claim 3, wherein the plurality of openings each comprise a plurality of cylindrical apertures extending at least partially through the at least one block.

5. The magnetic tool bit wallet of claim 3, further comprising a protective panel attached to the pliable body, and wherein the at least one block is attached to the protective panel.

6. The magnetic tool bit wallet of claim 5, wherein the at least one block comprises two opposed blocks attached to opposite ends of the protective panel.

7. The magnetic tool bit wallet of claim 1, wherein the rows of magnets comprise rows of disc magnets.

8. The magnetic tool bit wallet of claim 1, wherein the pocket portion of the pliable body further comprises an openable closure mechanism to selectively close the pocket.

9. The magnetic tool bit wallet of claim 8, wherein the closure mechanism comprises a zipper.

10. The magnetic tool bit wallet of claim 1, wherein the pliable body comprises a fabric body.

11. The magnetic tool bit wallet of claim 10, wherein the fabric body comprises a canvas fabric.

12. The magnetic tool bit wallet of claim 1, wherein a small pocket is formed in the magnetic support portion of the pliable body, and the first and second magnet assemblies are sized to approximately fill the small pocket such that the small pocket prevents the magnets in the rows of magnets from sliding away from the corresponding first and second ferromagnetic strips.

13. A magnetic tool bit wallet movable between a deployed configuration and a storage configuration, the magnetic tool bit wallet comprising:

a fabric body comprising an elongate fabric sheet folded about a fold line to define a first fabric panel portion fixed about a perimeter to a second fabric panel portion, the fabric body comprising a magnetic support section with an end flap, a bit retainer section extending from the magnetic support section comprising means for releasably retaining a plurality of tool bits, and a closeable pocket section extending from the bit retainer section; and a first elongate magnet assembly and a second elongate magnet assembly disposed between the first and second fabric panel portions, each of the first and second elongate magnet assemblies comprising a first ferromagnetic strip, a second ferromagnetic strip, and a row of magnets disposed between the first and second ferromagnetic strips; and wherein the magnets in each row of magnets are arranged with alternating magnetic polarities, and further wherein each magnet in the row of magnets in the first magnet assembly is oriented with an opposite polarity to a neighboring magnet in the row of magnets in the second magnet assembly.

14. The magnetic tool bit wallet of claim 13, wherein in the storage configuration the closeable pocket section overlies the bit retainer section and the first elongate magnet assembly engages the second elongate magnet assembly such that the magnetic support section is retained in a folded configuration such that the end flap overlies and engages the pocket section to thereby retain the pocket section in the storage configuration.

15. The magnetic tool bit wallet of claim 13, wherein the means for releasably retaining the plurality of tool bits comprises a pair of blocks, each block having a plurality of channels.

16. The magnetic tool bit wallet of claim 15, wherein the plurality of channels comprises a plurality of cylindrical apertures extending at least partially through the corresponding block.

17. The magnetic tool bit wallet of claim 16, further comprising a protective panel attached to the fabric body, and wherein the pair of blocks are adhesively attached to the protective panel.

18. The magnetic tool bit wallet of claim 13, wherein the rows of magnets comprise rows of disc magnets.

* * * * *